United States Patent [19]

Heath et al.

[11] 3,957,025

[45] May 18, 1976

[54] METHOD AND APPARATUS FOR CONTROLLING DISPLACED VAPOR EMISSIONS IN MOTOR VEHICLES

[75] Inventors: Stephen D. Heath, Chula Vista; Lorenzo Borbolla, Jr., Dulzura, both of Calif.

[73] Assignee: Rohr Industries, Inc., Chula Vista, Calif.

[22] Filed: Nov. 4, 1974

[21] Appl. No.: 520,606

[52] U.S. Cl. ..... 123/136; 220/85 VR

[51] Int. Cl.[2] ..... F02M 51/00

[58] Field of Search ..... 123/136; 220/85 VR

[56] References Cited

UNITED STATES PATENTS

| | | | |
|---|---|---|---|
| 3,093,124 | 6/1963 | Wentworth | 123/136 |
| 3,391,679 | 7/1968 | Williams et al. | 123/136 |
| 3,460,522 | 8/1969 | Kittler et al. | 123/136 |
| 3,515,107 | 6/1970 | Joyce | 123/136 |
| 3,515,108 | 6/1970 | Deeter et al. | 123/136 |
| 3,575,152 | 4/1971 | Wentworth | 123/136 |
| 3,581,782 | 6/1971 | Onufer | 123/136 |
| 3,672,180 | 6/1972 | Davis | 123/136 |
| 3,675,634 | 7/1972 | Tatsutomi et al. | 123/136 |
| 3,695,376 | 10/1972 | Fiedler et al. | 123/136 |
| 3,752,134 | 8/1973 | Hollis Jr. | 123/136 |

*Primary Examiner*—Wendell E. Burns
*Assistant Examiner*—James W. Cranson
*Attorney, Agent, or Firm*—Patrick J. Schlesinger

[57] ABSTRACT

A vapor emission control system adapted to accommodate displaced vapors generated during the filling of a motor vehicle storage tank, wherein a first storage tank is adapted to communicate sequentially with an intermediate vacuum accumulator and ultimately with the intake manifold of an internal combustion engine.

In the preferred embodiment a dispensing nozzle is inserted into vapor sealing engagement with a first liquid storage tank wherein said liquid storage tank is equipped with a unidirectional self venting gas cap. Upon insertion of the dispensing nozzle a unidirectional bypass line normally closed is opened via an entry port flap actuator. A regulated negative pressure head draws the displaced liquid fuel tank vapors sequentially through a first by pass valve, a first pressure regulator, a unidirectional check valve, a vacuum accumulator holding tank, a second unidirectional check valve which is also a flow regulator, a second pressure regulator, and finally into the intake manifold vacuum source of an internal combustion engine.

An alternative embodiment is described wherein the liquid storage tank is vented directly to the atmosphere via conventional two way vent. In this embodiment upon insertion of the dispensing nozzle, the entry port flap actuator closes the vent line which is normally open and simultaneously opens the normally closed unidirectional displaced vapor line to the vacuum accumulator.

11 Claims, 3 Drawing Figures

METHOD AND APPARATUS FOR CONTROLLING DISPLACED VAPOR EMISSIONS IN MOTOR VEHICLES

BACKGROUND OF THE INVENTION

1. Field of the Invention

This invention relates to a vapor emission control system for preventing the atmospheric escape of vapors generated during the liquid filling of a fuel tank.

More particularly, this invention relates to a method and apparatus for recapturing and controlling the vapor emission generated in motor vehicles during fuel tank filling.

A problem of long standing in the art has to deal with escaping vapors when transferring volatile liquids from a liquid source to a receiving tank. Vapors from the transferred fluid are generated because of elevated ambient temperatures, the volatility of the fluid, and kinetic energy imparted to the liquids being transferred. Additionally, receiving tank vapors seek container escape when displaced by the transferred liquid volume.

This problem has become particularly acute in recent years because of the increased legislative concern for environmental purification and the related energy crisis. Proposed legislation would require completely closed service station systems and/or closed automobile fuel systems. The present cost of satisfactory vapor recovery systems for service stations is extremely expensive.

2. Description of the Prior Art

Because of the aforementioned recognized art problem, various apparatus and operational methods have been developed to preclude vapor loss and noxious dissemination into the atmosphere. The most pertinent prior art to that disclosed by the instant invention relates to vapor emission control systems wherein the vapors are transferred to a separate holding tank for adsorbent storage and/or conventional scrubbing.

Representative of this art is a patent issued to G. Torazza, U.S. Pat. No. 3,695,243 wherein the displaced vapors are vapor drawn through a multiple vapor collection manifold into an air purged, activated carbon containing vapor trap. This reference, however, does not employ a vacuum accumulator.

Another vapor recovery apparatus is described in a patent issued to G. R. Onufer, U.S. Pat. No. 3,581,782. One embodiment of the Onufer patent provides as shown therein at FIG. 2 for fuel tank displaced vapors to be transferred via a fluid return line to a complicated, stationary, intermediate activated filter container which serves as a conventional scrubbing canister. Although a carburetor vacuum withdraws vapor from the canister, it does so only when the engine is running and then from an open system wherein air is passed upwardly through the activated charcoal.

SUMMARY OF THE INVENTION

The instant invention solves the aforementioned art problem by providing an inexpensive, portable vapor accumulator and associated vacuum control which operates during engine shut off for transferring the displaced vapors to the engine for subsequent combustion. This is accomplished by providing a first holding tank adapted to contain a supply of liquid fuel, a dispensing nozzle adapted to communicate with and effect a vapor tight connection with said first holding tank, a second tank adapted to temporarily accommodate transient vapors emitted from said first tank, an internal combustion engine intake vacuum source, a unidirectional delivery line emanating from said first holding tank and communicating sequentially in series relationship with said second holding tank and having a termination end at an entrance to said intake vacuum source, and a regulating means located in said delivery line adapted to maintain a continuous vacuum head at its termination end relative to the pressure existing in said first holding tank.

The invention discloses alternate embodiments of a method and associated apparatus which is adapted to work in a plurality of existing fuel tank storage systems. Where the liquid fuel tank is of more contemporary design and incorporates a unidirectional self venting tank cap, the displaced vapors are directly channelled to the internal combustion engine vacuum source. Where the liquid fuel tank includes a bidirectional vent to the atmosphere, the dispensing nozzle upon insertion actuates closure of the normally open vent and opening of the unidirectional displaced vapor vacuum line which is normally closed.

Furthermore, if the tank is normally vented via an engine return and associated burn off line, the dispensing nozzle insertion can be adapted to close off the normally open return line and open the displaced vapor by pass line.

Accordingly, it is an object of this invention to provide an inexpensive method and apparatus for recovering the displaced vapors generated during liquid storage tank fill operations.

A further object of this invention is to provide the automobile itself with a portable, self contained recovery system when preferably used in conjunction with a dispensing nozzle having an associated vapor sealing means.

Another object of this invention is to provide a recovery system employing a vacuum accumulator and associated pressure regulator means which effectuates vapor storage during engine shut off.

These and other objects, advantages, and novel features of the invention will become apparent from the following detailed description of the invention when considered in conjunction with the accompanying drawings wherein:

DESCRIPTION OF THE PREFERRED EMBODIMENT

Figure 1:
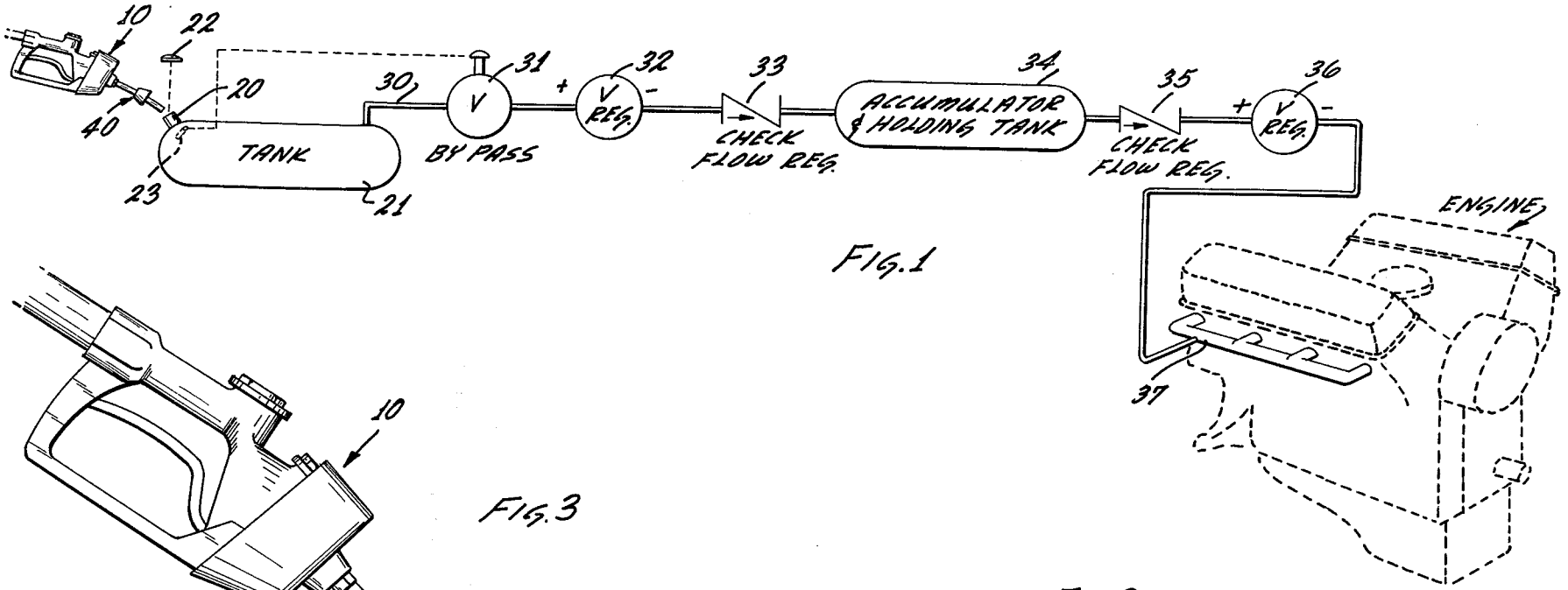
FIG. 1 is a schematic illustration of the mobile storge tank vapor control apparatus which depicts the vapor flow from the liquid fill tank through a pressure regulated flow line to an intermediate vacuum accumulator and ultimately to the internal combustion engine.

Referring to FIG. 1 a conventional liquid line dispensing nozzle 10 is shown inserted into an entry port 20 of any conventional motor vehicle liquid fuel storage tank 21. The dispensing nozzle 10 is preferably adapted to provide either a vapor tight seal when inserted into the entry port 20 or alternatively is adapted with an associated condensing means to prevent vapor escape through the entry port during filling. A suitable dispensing nozzle seal is shown in FIG. 3.

Figure 3:
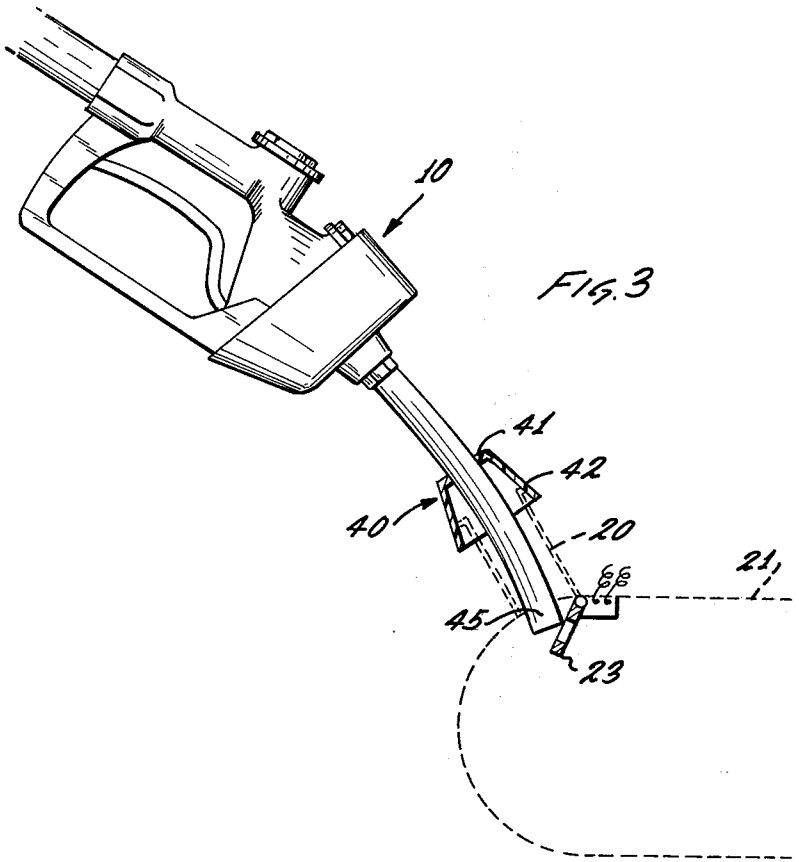
FIG. 3 is an isolated view of a dispensing nozzle adapted to accommodate a vapor tight seal with the fuel tank entry port.

Although various sealing means may be used to adapt conventional dispensing nozzles, FIG. 3 describes a preferred embodiment wherein an annular disposed flexible sealing means 40 is mounted about the emission end 45 of said dispensing nozzle. The sealing means comprises an annular base portion 41 which is directly bonded to the emission end 45 of the dispensing nozzle and an annular dispensing outer wall 42 the radius of which emanates outwardly and longitudinally downwardly from said dispensing nozzle. The sealing means may be made of any suitable flexible material, however the invention prefers a high density rubber impervious to the developed fuel vapors.

FIG. 3 also shows the flap actuator 23 in depressed, actuating configuration. The flap actuator 23 may also have an opening as shown in FIG. 3 to accommodate fuel tank access to a self venting gas tank cap when the flap actuator is spring biased to its normally closed position. Although the embodiment of FIG. 3 shows the opening to be a centrally disposed aperture of lesser dimension than the dispensing nozzle emission end 45, the opening may be of any configuration that permits self venting of the fuel tank via an associated venting cap. In those embodiments having a vent independent from the entry port, no actuator flap opening is requied. Additionally, the flap actuator may be of any conventional mechanical or electrical variety to control an associated valve hereinafter described. Representative of such conventional and commercially available control means is an electrical control such as a single pole single throw switch.

Similarly a dispensing nozzle with associated condensing means is disclosed and claimed in Applicant's patent application entitled "Vapor Recovery Apparatus Employing Dispensing Nozzle with Condensing Capacity", Ser. No. 489,818, filed July 18, 1974.

Although the invention prefers for optimum vapor recovery either a vapor tight entry port seal or a dispensing nozzle having an associated condensing capacity, the invention will satisfactorily operate without either as the vacuum source diverts the major portion of displaced vapors through the recovery system described below.

Figure 2:
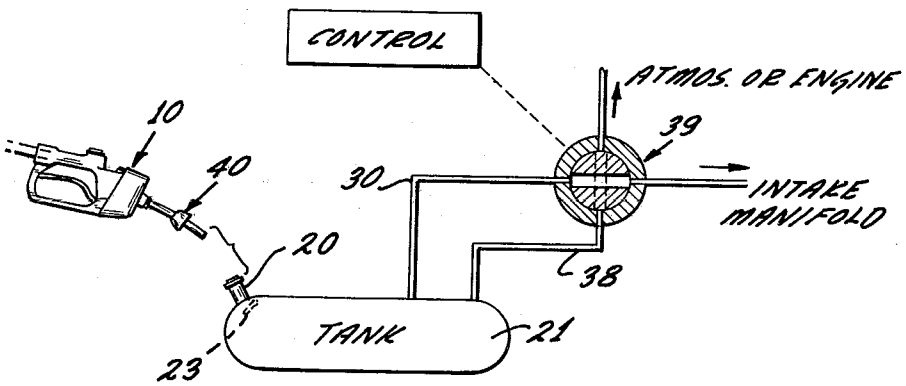
FIG. 2 is a partial schematic illustration of an alternate embodiment which shows an independent fuel tank vent normally open which is simultaneously closed during filling of the storage tank.

When the fuel tank is closed, it is preferably capped with a conventional unidirectional self-venting cap 22 to preclude vapor escape to the atmosphere. If the fuel tank is vented apart from the entry port cap as shown in FIG. 2, the vent is alternatively opened and closed as described below.

Referring again to FIG. 1, a unidirectional vapor delivery line 30 emanates from the top of said storage tank 21 and communicates sequentially with a first bypass valve 31, a first pressure regulator 32, a unidirectional check valve 33, a vacuum accumulator tank 34, a second unidirectional check valve 35, a second pressure regulator 36, and finally with a vacuum source associated with an internal combustion engine represented generally as 37.

Although various vacuum sources could be used the invention prefers the vacuum generated by the intake manifold on a conventional internal combustion engine. The intake manifold generates a vacuum pressure of approximately 24 inches of mercury.

Accordingly, when the engine is turned off, pressure regulator 36 of conventional design is chosen so that it develops and maintains a vacuum pressure of approximately 22 inches of mercury with respect to the vacuum accumulator side of the pressure regulator 36. Similarly, pressure regulator 36 is chosen so that it is normally closed until opened by a gate level pressure, in this case a vacuum pressure of 24 inches of mercury as established via the intake manifold.

Directly adjacent the pressure regulator 36 is check valve 35 which permits unidirectional flow of fuel vapors toward the internal combustion engine as said vapors are drawn out of the vacuum accumulator 34. Check valve 35 is chosen to serve as an effective flow regulator so that when the engine is turned on the vapors do not surge into the intake manifold thereby causing excessive engine choking.

Although the accumulator 34 can be made out of various materials, for reasons of economy and convenience, the invention prefers a tank of stamped steel construction. Stamped steel is of sufficient strength to avoid collapse at the extreme operational vacuum pressure levels of the disclosed invention. Similarly the accumulator 34 can take any number of shapes so as to conform to the particular chassis configuration of the vehicle to which it is attached.

The outer limits of the volume requirements for the accumulator are determined by the size of the fuel tank 21 and by the material construction of the accumulator itself. The fact that the pressure in the accumulator 34 is less than that of fuel tank 21 is more than offset by the fact that the fuel tank 21 will never consist of a full tank of pure fuel vapor. Therefore the size of accumulator 34 can be considerably smaller in size than that of its associated fuel tank. The higher the level of vacuum which can be maintained in the accumulator, the smaller the size of said accumulator.

Fuel vapors are drawn into the accumulator via check valve 33 which communicates directly with differential pressure regulator 32 of conventional design and commercial availability. Pressure regulator 32 is chosen to develop and maintain a constant pressure differential of a maximum of ¼ P.S.I. with respect to the fuel tank side of said pressure regulator and atmospheric pressure which would be the higher pressure. Experience has shown that the change in pressure between fuel tank 21 and the ambient air pressure should not exceed ¼ P.S.I. Accordingly, pressure regulator 32 is chosen to stay within these limits for tanks of conventional design and construction. Obviously by appropriate choice of tank materials and system construction, the pressure tolerance levels can be commensurately increased. Therefore the preferred system pressure parameters are chosen to accommodate commercially available designs.

Directly communicating with fuel tank 21 is a conventional by pass valve 31 which directs the displaced fuel vapors through pressure regulator 32. By pass valve 31 is actuated via control means associated with entry port 20. Accordingly, by pass valve 31 is normally closed. When the dispensing nozzle is inserted into entry port 20 and liquid fill is initiated, by pass valve 31 is automatically opened and displaced vapors are drawn out of said tank via the aforementioned route. Although various control means may be used, a preferred embodiment describes a pivoted flap actuator 23, which upoon dispensing nozzle depression actuates the opening of by pass valve 31.

OPERATION OF THE PREFERRED EMBODIMENT

A vacuum is developed and maintained in the system by pressure regulator 36 when the internal combustion engine is shut off. Liquid fill is then initiated from an external fuel source by inserting dispensing nozzle 10 into the fuel tank entry port 20. Upon insertion of dispensing nozzle 10 into the entry port 20, flap actuator 23 is depressed thereby actuating the opening of normally closed by pass valve 31.

The liquid fuel displaced fuel vapors are then vacuum drawn through by pass valve 31 via pressure regulator 32. Because of the lesser pressure existent in the direction of pressure regulator 36 the fuel vapors continue through check valve 33 into the stamped steel vacuum accumulator 34 where the fuel vapors are temporarily held.

Upon completion of fuel tank filling, dispensing nozzle 10 is withdrawn, flap actuator 23 is spring returned, and by pass valve 31 is simultaneously closed. Fuel vapors are precluded from returning to the fuel tank by means of unidirectional check valve 33.

When the engine 37 is started, a vacuum approximately 24 inches of mercury is developed with the intake manifold vacuum source and fuel vapors are drawn out of the vacuum accumulator 34 through the unidirectional check valve 35 which is of conventional design to accommodate a chosen flow rate. Said fuel vapors then pass through pressure regulator 36 into the intake manifold for subsequent burn off in the internal combustion engine.

Depending upon the particular automobile and its given engine performance characteristics, flow regulator 35 is chosen to accommodate a preselected flow rate into the intake manifold so as not to choke off or upset the desired air to fuel ratio.

DESCRIPTION OF ALTERNATE EMBODIMENT

As described above, the fuel tank 21 is normally vented through self venting cap 22 which permits pressure equalization by premitting air flow into the tank but restricts the fuel vapor out of said tank. An alternate embodiment is depicted in FIG. 2. Those parts of FIG. 2 common to FIG. 1 are represented by the same reference numerals. Fuel tank 21 includes an independent vent line 38 which is normally open to the atmosphere via the two way by pass valve 39 or can be connected to a vent line to the engine as on recent model motor vehicles. Although various valves of conventional design may be used, the invention prefers for this embodiment a two position, one way valve wherein when said actuator flap is closed (electrical circuit open) the valve is normally open in the vertical first position as shown in phantom in FIG. 2. When said actuator flap is open (electrical circuit closed), the valve is normally open in the horizontal second position shown in FIG. 2.

During fill operation, dispensing nozzle 10 is inserted into entry port 20. Upon insertion, the depressed actuating flap 23, in addition to opening flow line 30 through by pass valve 39, closes vent line 38 which is normally open to the atmosphere. Similarly, when liquid filling is completed, the actuating flap 23 is spring returned upon nozzle withdrawal, thereby causing flow line 30 to close and vent line 38 to reopen.

The remaining operational and apparatus aspects of this embodiment are analogous to those described above in the preferred embodiment as the fuel tank and associated vent line are integrated into the system environment.

While preferred embodiments of the vapor recovery system are shown and described above, it is understood that various changes and modifications can be made in their construction and relative organization of elements without departing from the scope of the invention as defined in the following claims:

I claim:

1. A vapor recovery system in a motor vehicle for preventing escape of fuel vapor to the atmosphere during liquid fuel transfer comprising in combination:

a. a holding tank adapted to contain a supply of liquid fuel;

b. a dispensing nozzle adapted to communicate with said holding tank;

c. a vacuum accumulator tank adapted to temporarily accommodate transient vapors emitted from said first tank;

d. an internal combustion engine intake vacuum source;

e. a unidirectional delivery line from said first holding tank communicating sequentially in series relationship with said vacuum accumulator tank and having a termination end at an entrance to said intake vacuum source; and f. regulating means located in said delivery line and maintaining a continuous negative pressure head and restricted communication between the holding tank and the vacuum accumulator tank during communication of the dispensing nozzle with the holding tank.

2. A vapor recovery system according to claim 1 wherein said dispensing nozzle is adapted to effect a vapor tight engagement with said first holding tank.

3. A vapor recovery system according to claim 1 wherein said delivery line is opened and closed via an integrated by pass valve and associated control means.

4. A vapor recovery system according to claim 3 wherein said control means consists of a servo control actuated by dispensing nozzle entry and exit from said first holding tank.

5. A vapor recovery system according to claim 1 wherein said regulating means comprises a first pressure regulating valve inserted between said first and second tanks and a second pressure regulating valve inserted intermediate said second vacuum accumulator tank and said vacuum source, wherein said first and second valves are adapted to maintain an increasing negative pressure head progressing sequentially from said first holding tank to said second pressure regulating valve.

6. A vapor recovery system according to claim 5 wherein said unidirectional delivery line includes a first check valve located between said first pressure valve and said second vacuum accumulator tank and a second check valve located between said second vacuum accumulator tank and said second pressure valve.

7. A vapor recovery system for preventing escape of fuel vapors to the atmosphere during liquid fuel transfer to a holding tank comprised of the following apparatus:

a. a first liquid storage tank having a vent normally open to the atmosphere;

b. a dispensing nozzle adapted to effectuate a vapor tight sealing engagement when inserted into said storage tank;

c. a unidirectional vapor by pass line emanating from said storage tank and communicating sequentially with an intermediate vacuum accumulator tank and ultimately with an internal combustion engine vacuum source;

d. pressure regulation means for developing a negative pressure head in said by pass line wherein said negative pressure is maintained during engine shut off; and e. an actuating means for opening the normally closed by pass line during storage tank filling, and for simultaneous closing of said normally open vent during storage tank filling.

8. A vapor recovery system according to claim 7 wherein said regulating means comprises a first pressure regulating valve inserted between said storage tank and said vacuum accumulator and a second pressure regulating valve inserted between said vacuum accumulator and said vacuum source, wherein said first and second valves are adapted to maintain an increasing negative pressure head progressing sequentially from said storage tank to said vaccum source.

9. A vapor recovery system according to claim 8 wherein said unidirectional by pass line includes a first check valve located between said first pressure valve and said vacuum accumulator and a second check valve located between said vacuum accumulator and said second pressure valve.

10. A method for preventing escape of fuel vapors to the atmosphere during liquid fuel transfer to a motor vehicle storage tank comprising the following steps:

a. inserting a liquid source into vapor tight engagement with said storage tank;

b. displacing storage tank vapors with liquid fuel;

c. withdrawing said storage tank vapors via integrated vacuum means and delivery line access to an intermediate vacuum accumulating tank;

d. closing off the delivery line access from said storage tank; and e. withdrawing said vapors from said intermediate accumulating tank into a vacuum source of an associated internal combustion engine.

11. A method for preventing escape of fuel vapors to the atmosphere during liquid fuel transfer to a holding tank in a system including an internal combustion engine comprising the following steps:

a. establishing a unidirectional vapor communication line sequentially in series between a fuel holding tank adapted to contain a supply of liquid, a second holding tank adapted to accommodate transient vapor, and an internal combustion engine vacuum source wherein pressure regulating means are located intermediate said first and second holding tanks and intermediate said second holding tank and said vacuum source.

b. developing a continuous vacuum pressure head at the vacuum source end of said communication line relative to the first holding tank end of said communication line;

c. inserting a liquid source into vapor tight engagement with said first holding tank;

d. initiating liquid delivery into said first holding tank thereby actuating simultaneous opening of said communication line; and e. withdrawing displaced vapors from said first tank into said internal combustion engine via said second holding tank.

* * * * *